US011988470B2

(12) United States Patent
Runk

(10) Patent No.: US 11,988,470 B2
(45) Date of Patent: May 21, 2024

(54) FOLDED COIL INDIVIDUAL TUBE SPACERS

(71) Applicant: MAHLE International GmbH, Stuttgart (DE)

(72) Inventor: Robert Louis Runk, Lockport, NY (US)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 17/529,361

(22) Filed: Nov. 18, 2021

(65) Prior Publication Data

US 2023/0152048 A1 May 18, 2023

(51) Int. Cl.
*F28F 9/013* (2006.01)
*F28D 1/047* (2006.01)

(52) U.S. Cl.
CPC ..... *F28F 9/0131* (2013.01); *F28D 1/0476* (2013.01); *F28F 2240/00* (2013.01)

(58) Field of Classification Search
CPC .... F28D 1/0476; F28D 1/0478; F28F 9/0131; F28F 2240/00
See application file for complete search history.

(56) References Cited

U.S. PATENT DOCUMENTS

| | | | | |
|---|---|---|---|---|
| 4,831,701 | A * | 5/1989 | Yutaka | F28D 1/0478 228/183 |
| 5,531,268 | A | 7/1996 | Hoshino et al. | |
| 2017/0343288 | A1 | 11/2017 | Joardar | |
| 2021/0231375 | A1 * | 7/2021 | Sienel | F28D 1/0476 |

FOREIGN PATENT DOCUMENTS

| | | | | |
|---|---|---|---|---|
| CN | 203518352 | U | 4/2014 | |
| CN | 104110977 | A | 10/2014 | |
| CN | 106196757 | A * | 12/2016 | F25B 39/04 |
| EP | 299688 | A * | 1/1989 | F16L 3/23 |
| EP | 2884209 | A1 | 6/2015 | |

* cited by examiner

*Primary Examiner* — Eric S Ruppert
(74) *Attorney, Agent, or Firm* — Dickinson Wright PLLC

(57) ABSTRACT

A plurality of spacer devices for incorporation into a bent-tube heat exchanger that includes a spine and one or more fingers that protrude from opposite sides of the spine. The fingers are configured to exert a force against the tubes and to provide and maintain a separation between the tubes in the folded region. A heat exchanger includes a plurality of the spacer devices, such that one spacer device is positioned on every two tubes. The tubes may also include a coating in the folded region in order to reduce corrosion and increase the life-time of the heat exchanger. The method of forming the heat exchanger includes placing one of the spacer devices on every other tube, such that the fingers lay on the tubes in the region to be folded and assist in the folding process.

16 Claims, 7 Drawing Sheets

FOLDED COIL INDIVIDUAL TUBE SPACERS

FIELD

This disclosure relates generally to heat exchangers or evaporators. More specifically, this disclosure relates to heat exchangers that include bent tubes in a coil-like configuration.

BACKGROUND

The statements in this section merely provide background information related to the present disclosure and may not constitute prior art.

Heat exchangers 1, such as the one shown in FIGS. 1A and 1B, which incorporate a bent tube structure 5, are becoming more popular than conventional plate and fin heat exchangers due to their compactness, low weight, structural rigidity, and enhanced performance characteristics. These heat exchangers 1 are also more environmentally friendly due to the smaller amount of refrigerant that needs to be circulated through their bent tubes 5. Generally, the bent tubes 5 exhibit a flattened cross-section 10 along with multiple parallel flow channels (4). A plurality of fins 15 extend between the tubes 5 in order to enhance efficiency with respect to thermal energy exchange between the refrigerant and the surrounding environment. Each of the tubes 5 is in fluid communication with one or more manifolds 13 having an inlet 17 or an outlet 23.

When tubes 5 are folded in half to create a multiple row coil-like configuration 20, the tubes 5 in the folded region, which have no centers between them, will be in direct contact 25. Tubes 5 that are in constant contact with each other can lead to continual rubbing and overtime result in the formation of leaks. For coil-like configurations 20 where the folded region is located at the bottom of the heat exchanger, the contact made by the tubes may also allow water to gather with limited ability for proper drainage. This accumulation of water may cause the acceleration of corrosion processes, thereby weakening the structural integrity of the tubes 5. Thus, when tubes 5 are allowed to remain in direct contact 25 with each other, the coils are predestined to prematurely fail.

SUMMARY

The present disclosure generally provides a spacer device for incorporation into a bent-tube heat exchanger. This spacer device comprises one or more fingers that protrude from opposite sides of the spine. The fingers in the spacer device are configured to exert a force against the tubes and to provide and maintain a separation between two of the tubes in the folded region.

According to another aspect of the present disclosure, a bent-tube heat exchanger is provided. This heat exchanger comprises a plurality of tubes folded in a region to form a coil-like configuration having a flattened cross-section along with multiple parallel flow channels. This heat exchanger includes a plurality of fins that extend between the tubes. In addition, the heat exchanger includes one or more manifolds that form an inlet and outlet for fluid flow within the heat exchanger. Each of the plurality of tubes in the heat exchanger is in fluid communication with the one or more manifolds. The heat exchanger further includes a plurality of spacer devices comprising a spine and a plurality of fingers that provides and maintains a separation between the tubes in the folded region.

According to yet another aspect of the present disclosure, a method for providing and maintaining separation between tubes during the formation of a bent-tube heat exchanger is provided. This method generally comprises the steps of providing a plurality of spacer devices having a thickness (T); providing a plurality of tubes; placing one of the spacer devices on every other tube, such that each finger in the spacer device is located between two of the tubes; and folding the tubes in a region to form a coil-like configuration, such that the spacer device remains between the tubes in the folded region. The thickness (T) of the spacer device represents the separation that is provided and maintained by the fingers between the tubes in the folded region.

Optionally, the method may further include maneuvering the spacer device into place and/or holding the spacer device in place during the folding of the tubes through the use of a removable connector located between two or more of the spacer devices. This connector is subsequently removed after placement of the spacer devices. The method may further include covering one or more of the tubes in the region to be folded with a protective coating that either provides a physical barrier between the tubes and the oxidizing elements in the environment or is a sacrificial material that preferentially corrodes before the tubes.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

The drawings described herein are for illustration purposes only and are not intended to limit the scope of the present disclosure in any way. It should be understood that throughout the description, corresponding reference numerals indicate like or corresponding parts and features.

DETAILED DESCRIPTION

The following description is merely exemplary in nature and is in no way intended to limit the present disclosure or its application or uses. For example, the device made and used according to the teachings contained herein are described throughout the present disclosure in conjunction with a bent tube or coiled heat exchanger used in an air conditioner system in order to more fully illustrate the construction and the use thereof. The incorporation and use of such a device in other heating, ventilation, air conditioning, and refrigeration applications wherein a bent tube or coiled heat exchanger would be desirable is contemplated not to exceed the scope of the present disclosure.

The present disclosure generally provides a device configured as a spacer that provides separation between the bent tubes or coil during the production and operation of a heat exchanger. During the production of a heat exchanger, the spacer device is inserted in between the tubes before folding in order to keep the tubes from touching during and after folding. This spacer device remains in contact with the tubes or coil-like configuration during the operation of the heat exchanger in order to maintain the spacing and to assist in guiding the drainage of condensate. Since the spacer device keeps the tubes of the folded core from coming in direct contact with one another, the reduction in frictional rubbing during production and operation will extend the life-time associated with the coil.

The spacer device may be formed of any soft plastic or hard rubber material. Such materials may include, without limitation, polyurethanes, thermoplastic elastomers (TPEs), polyolefins, epoxies, fluoropolymers, silicones, polyamide, polycarbonate, polyesters, polyethylene, polyvinyl chloride, natural rubber (NR), styrene-butadiene rubber (SBR), ethylene propylene diene monomer rubber. (EPDM), nitrile butadiene rubber (NBR) and/or mixtures and combinations thereof. Alternatively, the spacer device is comprised substantially of one type of soft plastic or hard rubber material. The hardness of the material generally ranges from about 5 to about 85 (Shore A durometer) or less than 45 (Shore D durometer). The measurement of Shore hardness may be performed according to ASTM D2240, ISO 868, or ISO 7619-1:2010 standard test methods.

Figure 1B:
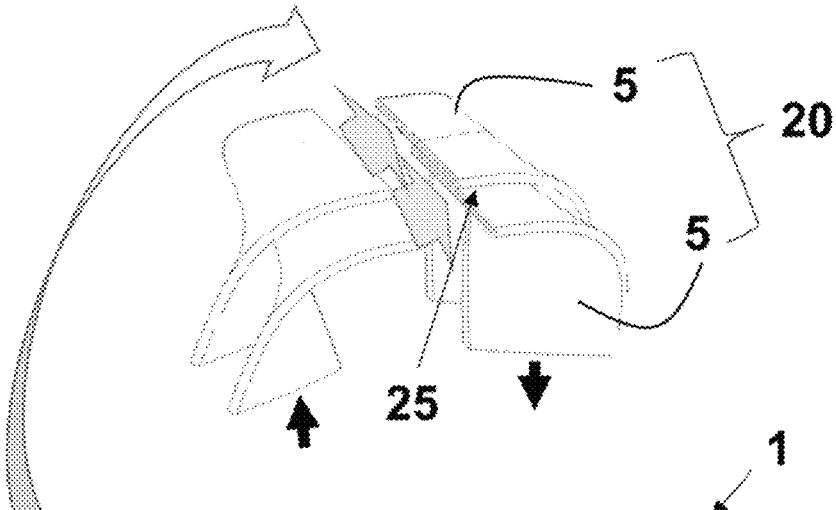
FIG. 1B is an enlarged schematic representation of the bent sections of two tubes in the heat exchanger of FIG. 1A.
Figure 1A:
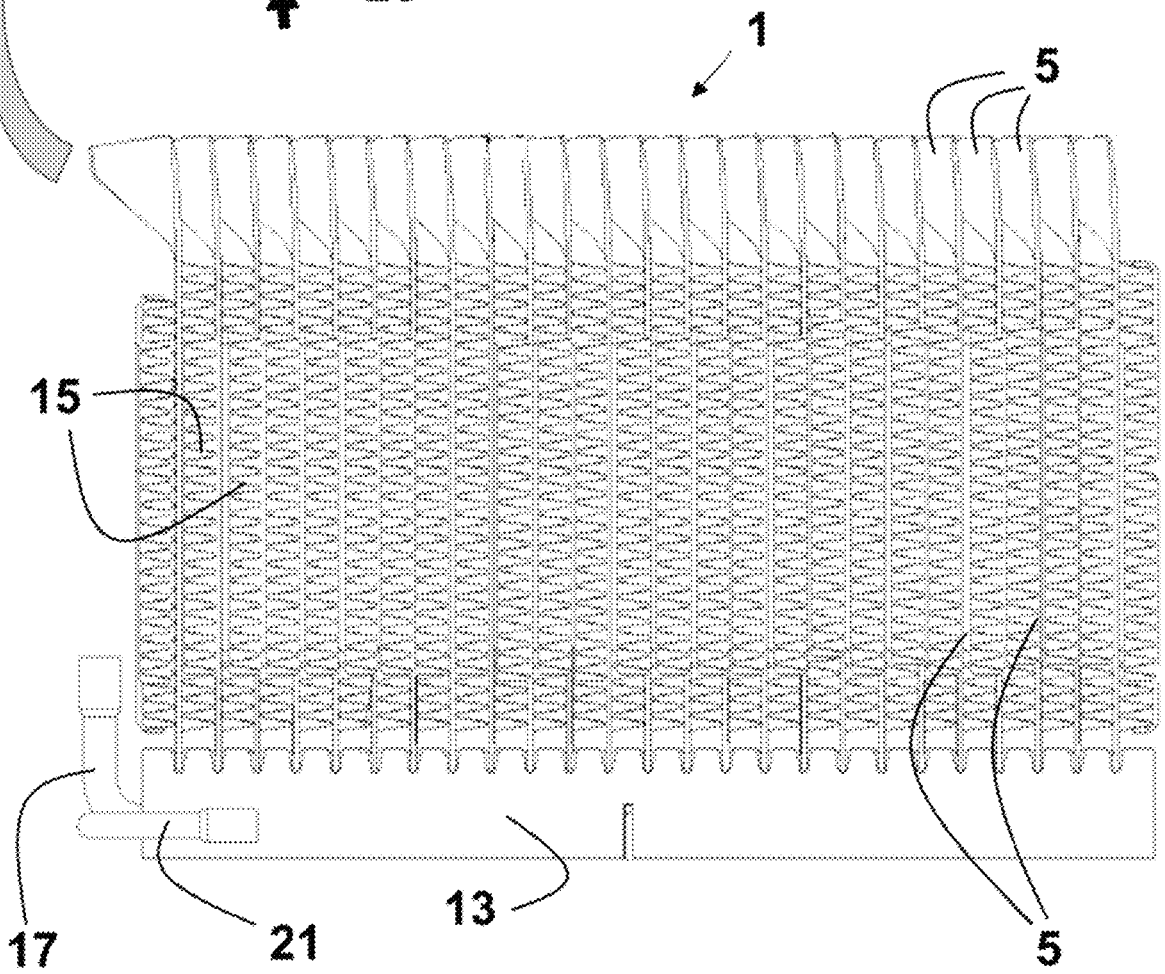
FIG. 1A is a schematic representation of a conventional bent tube or coiled heat exchanger shown from a side view perspective.
Figure 2A:
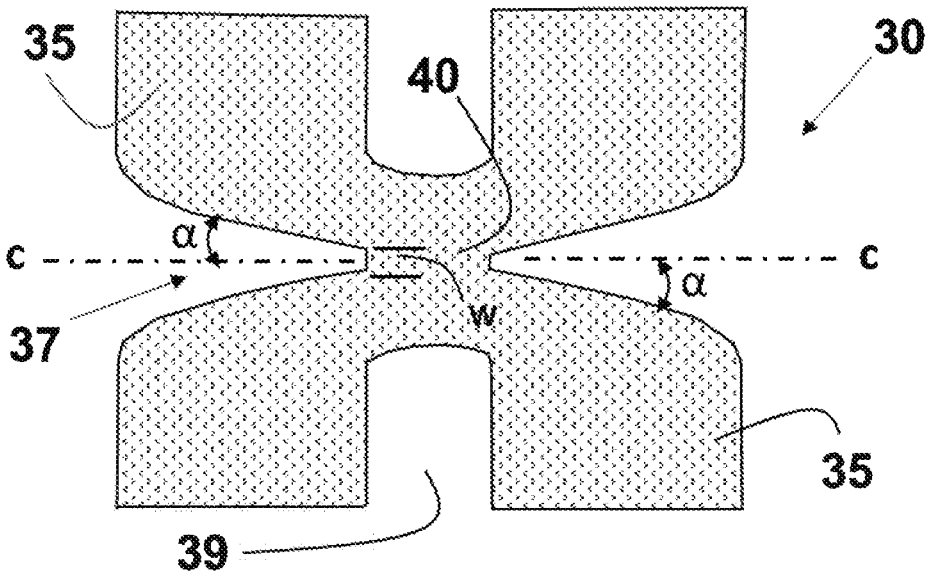
FIG. 2A is a schematic representation of a spacer device constructed according to the teachings of the present disclosure that is configured to keep the bent tubes in the heat exchanger of FIG. 1 separated.
Figure 2B:
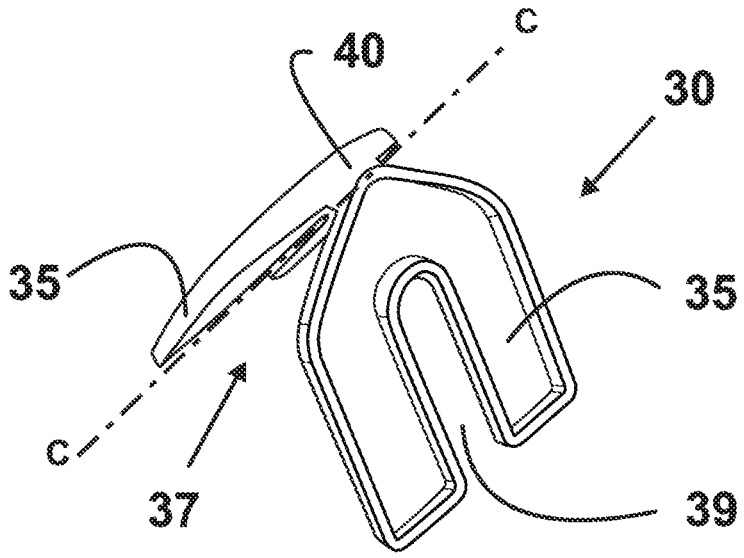
FIG. 2B is a side view of the spacer device of FIG. 2A shown in a bent configuration.
Figure 2C:
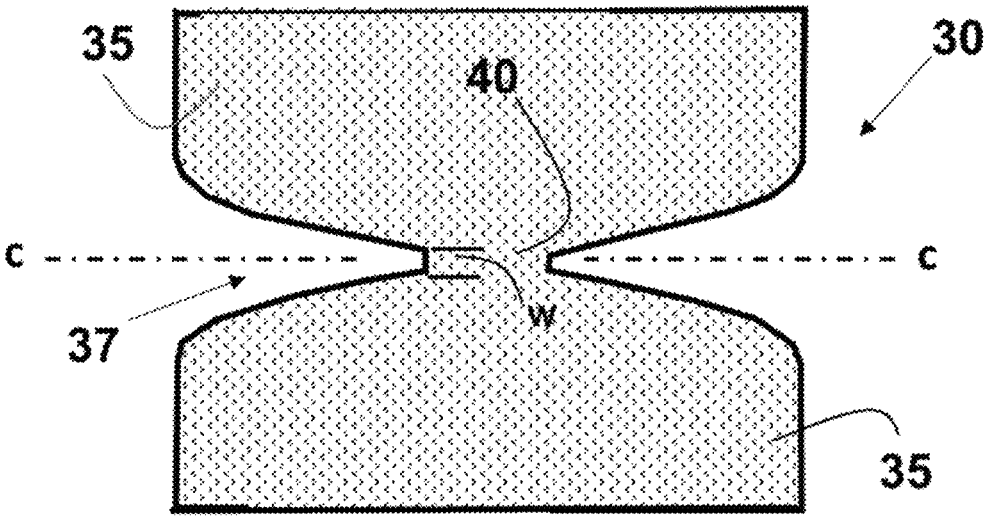
FIG. 2C is a schematic representation of another spacer device constructed according to the teachings of the present disclosure.
Figure 2D:
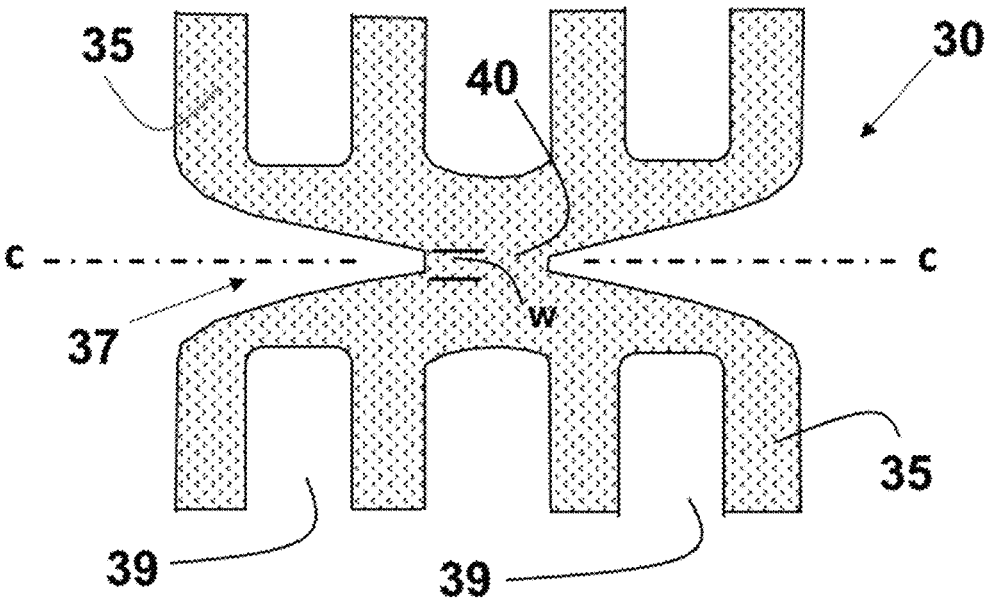
FIG. 2D is a schematic representation of yet another spacer device constructed according to the teachings of the present disclosure.

There are many different design configurations that could be used as the spacer device with variations in the thickness of the material, the length of the protruding fingers, the number of protruding fingers, and the angle at which the fingers protrude from the device being predetermined as necessary to optimize performance for heat exchangers used in different applications. Several possible design configurations are shown in FIGS. 2A-2D. The design configuration of the spacer device 30 generally includes one or more fingers 35 that protrude from both sides of a backbone or spine 40, such that the spacer device 30 may be folded in half at the spine 40 and placed over every other tube in order for at least one finger 35 being located between each tube prior to the initiation of the folding process. The number of fingers 35 located on each side of the spacer device 30 may be any number that is greater than or equal to one. In FIG. 2A-2B, two fingers 35 are shown to protrude from each side of the spine 40, while in FIG. 2C, one finger 35 is highlighted and in FIG. 2D three fingers 35 protrude from each side of the spine 40. Alternatively, two fingers 35 protrude from each side of the spine 40 in the spacer device 30. The configuration of fingers 35 protruding from each side of the spine 40 may be asymmetrical or symmetrical. Alternatively, the configuration of fingers 35 protruding from each side of the spine 40 are symmetrical.

When the number of fingers 35 located on each side of the spine 40 of the spacer device 30 is greater than one, the fingers 35 are separated by one another via a slot 39. This slot 39 may comprise any desirable shape, including, but not limited to, elliptical, circular, triangular, rectangular, or square. The slot 39 provides a weight savings in that less soft plastic or hard rubber is used in forming the spacer device 30. The slot 39 may also be configured to assist in the folding process and/or to hold the spacer device 30 in position during the folding process.

Still referring to FIGS. 2A-2D, when desirable, the fingers 35 may be configured, such that they exert a force against the tubes in a certain direction. This spacer device 30 may be inserted between the tubes before the pre-bend process in order to aid in the folding or bending of the tubes. In this respect, the spacer device 30 may be bent at the spine 40 around the center-line (c) and placed on or over the edge of every other tube. The spine 40 generally has a width (w) that is at least same size as the width of the channel flow path formed upon bending the tubes in the folded region to create the coil-like configuration. Alternatively, the width (w) of the spine 40 is slightly greater than the channel flow path that is formed by the bent tubes.

Each of the symmetric or asymmetric finger configurations located on each side of the spine 40 in the spacer device 30 are separated by a slit 37 in which the tube may be at least partially placed. When desirable, the fingers 35 may also be curved into a pre-determined shape providing an angle (a) with respect to the center-line (c) of the spine 40 that is configured to be compatible with and assist in the folding process of the tubes. The angle (a) may be any acute angle depending upon the degree of the bend desired for the tubes. The shape of the slit 37 generally corresponds to the shape of the outer surface of the finger configuration in order to assist in the placement of and/or the folding of the tubes.

Figure 3A:
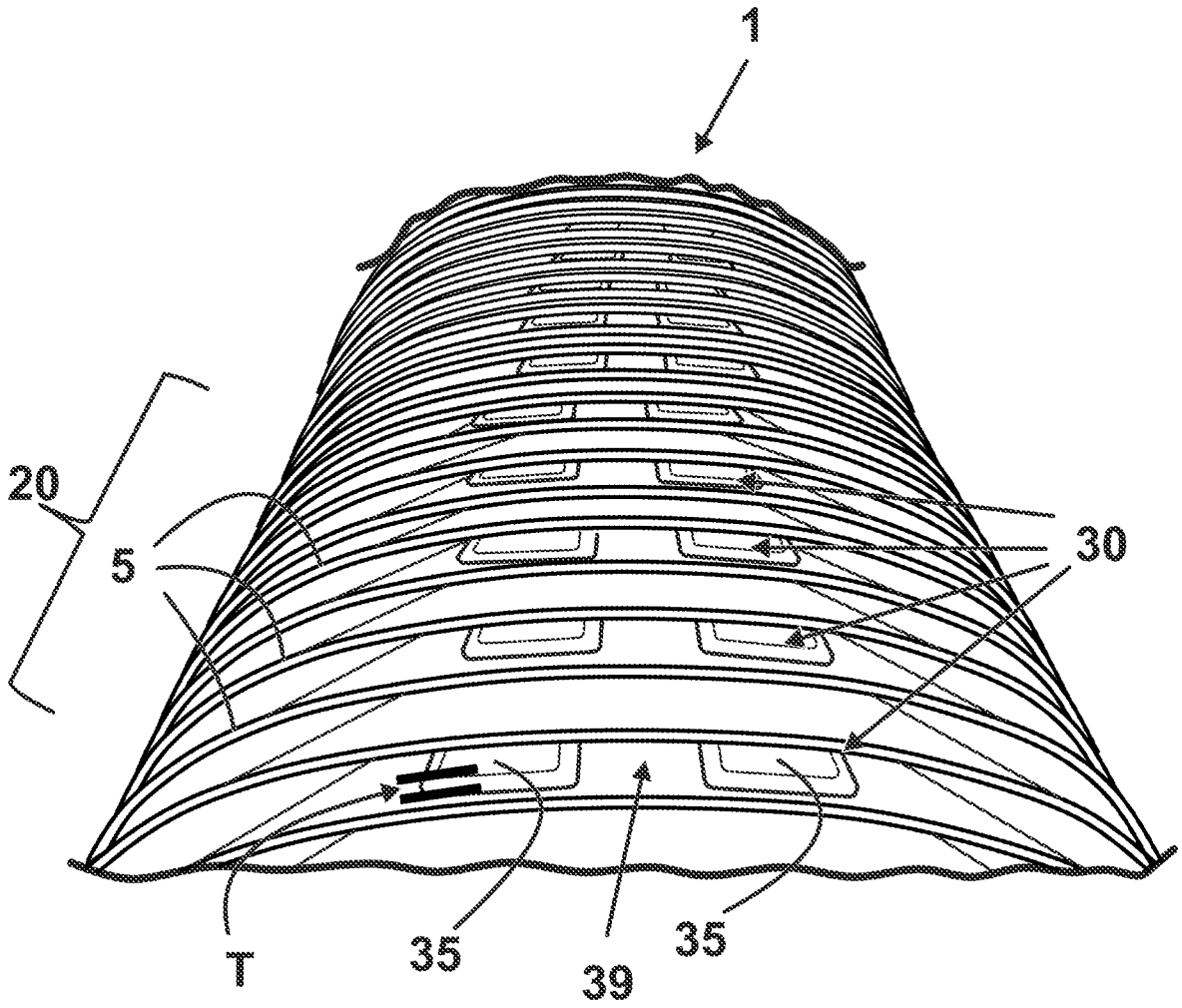
FIG. 3A is a top-down view of the spacer device of FIGS. 2A and 2B separating the tubes in a folded region of a heat exchanger according to the teachings of the present disclosure.
Figure 3B:
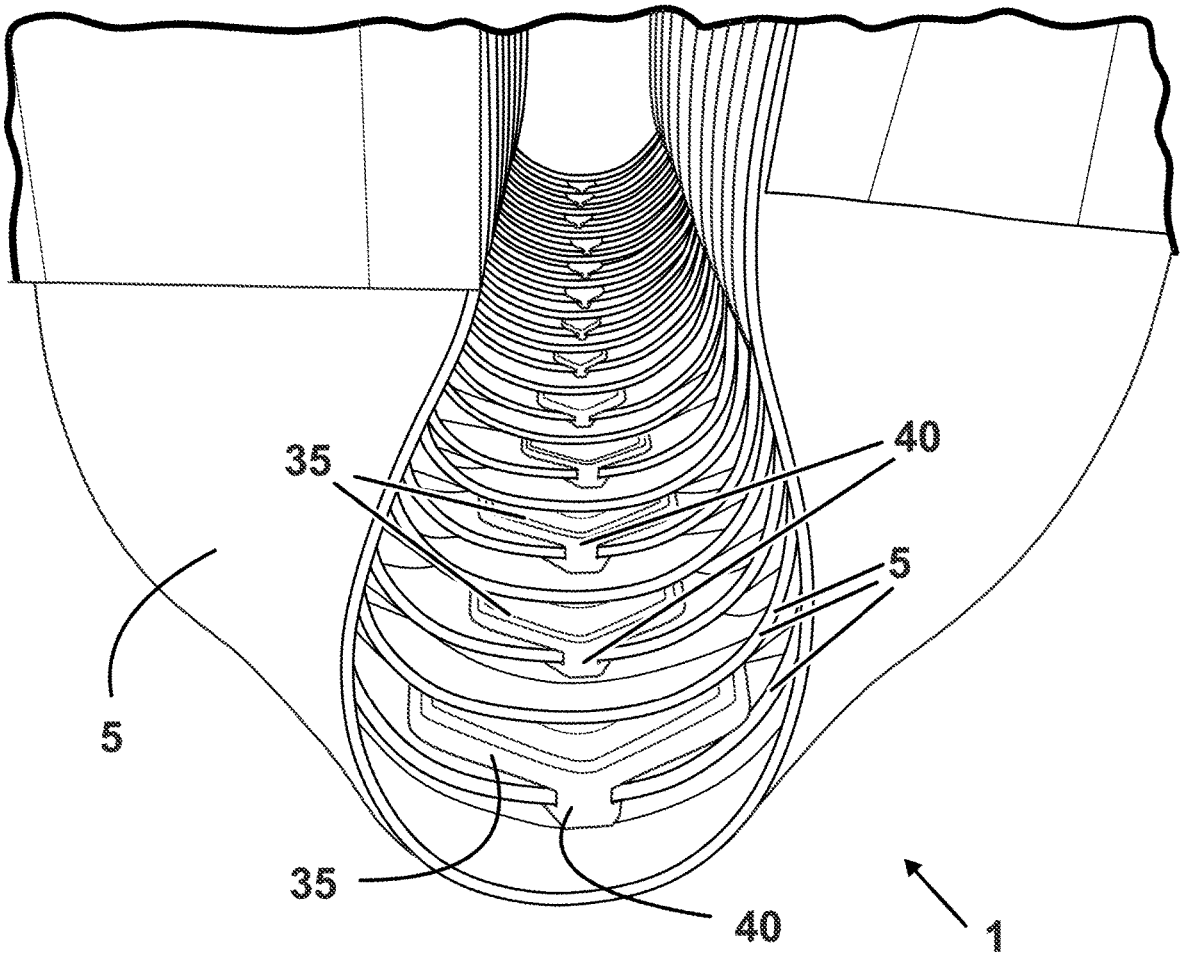
FIG. 3B is a bottom-up view of the spacer device of FIGS. 2A and 2B separating the tubes in a folded region of a heat exchanger according to the teachings of the present disclosure.

Referring now to FIGS. 3A and 3B, the spacer device 30 fits tightly, e.g., securely, between the bent or folded tubes 5 during and after the folding process. The contact between the spacer device and the surface of the bent or folded tube is such that the spacer device usually does not move during the folding process; alternatively, the spacer device moves minimally during the folding process. In the folding process, the fingers 35 lay in close contact with the tubes 5 and provide the correct spacing between tubes 5. The thickness (T) of the material used to form the spacer device 30 represents the spacing or separation that is provided by the fingers 35 of the device 30 between tubes 5. The thickness (T) of the material of the spacer device 30 is best shown in FIG. 3A. For coils 20 with the fold at the bottom, the fingers 35 left in the coil-like configuration 20 will help guide condensate out of the center of the coil-like configuration 20, thereby, assisting in the drainage of the condensate from the folded region of the tubes that form the bent-tube heat exchanger.

Figure 4:
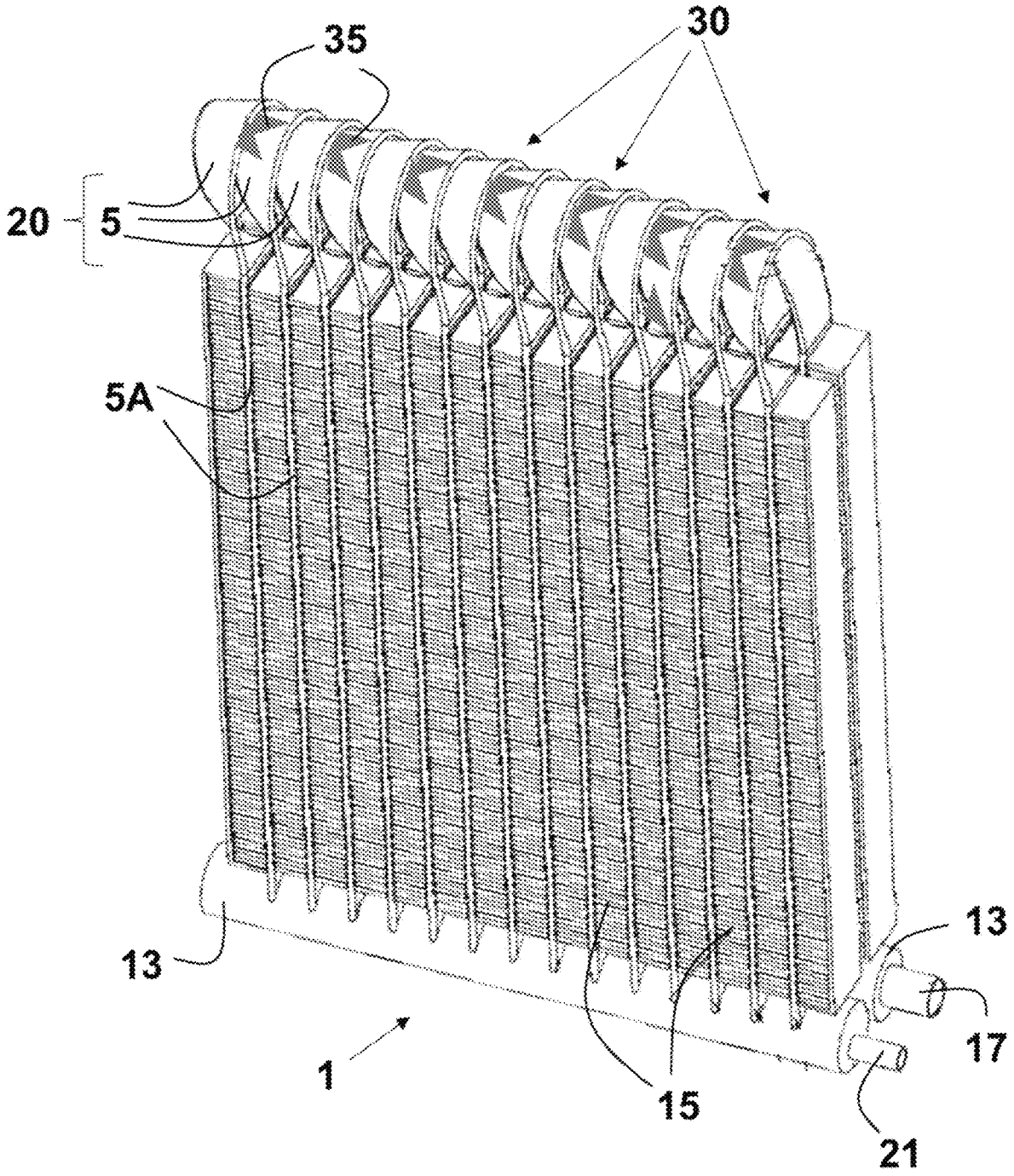
FIG. 4 is a schematic representation of a heat exchanger having the spacer device of FIGS. 3A and 3B incorporated therein as taught by present disclosure shown from a side view perspective.

According to another aspect of the present disclosure, a bent-tube heat exchanger is provided. Referring now to FIG. 4, this bent-tube heat exchanger 1 generally comprises a plurality of tubes 5 folded in a region 20 to form a coil-like configuration having a flattened cross-section along with multiple parallel flow channels 5A. This heat exchanger 1 includes a plurality of fins 15 that extend between the tubes 5. In addition, the heat exchanger 1 comprises one or more manifolds 13 that form an inlet 17 and outlet 21 for fluid flow within the heat exchanger 30. Each of the plurality of tubes 5 is in fluid communication with the one or more manifolds 13. A spacer device 30 as previously described above and further defined herein comprising a spine 40 (shown in FIG. 3B) and a plurality of fingers 35 is used to provide and maintain a separation between the tubes in the folded region.

When necessary or desirable one or more of the tubes 5 in the folded region may also be covered with a protective coating (not shown). Alternatively, at least one of the tubes 5 is coated in the folded region. This coating may be an organic coating that acts as a physical barrier between the metal of the tubes and the oxidizing elements in the environment. The coating may also be an inorganic material, such as without limitation a sacrificial material, e.g., a metal, which is applied or plated onto the tubes and preferentially corrodes before the tubes. The application of such a coating makes the tubes 5 in the folded region tougher and less susceptible to premature failure.

Figure 5:
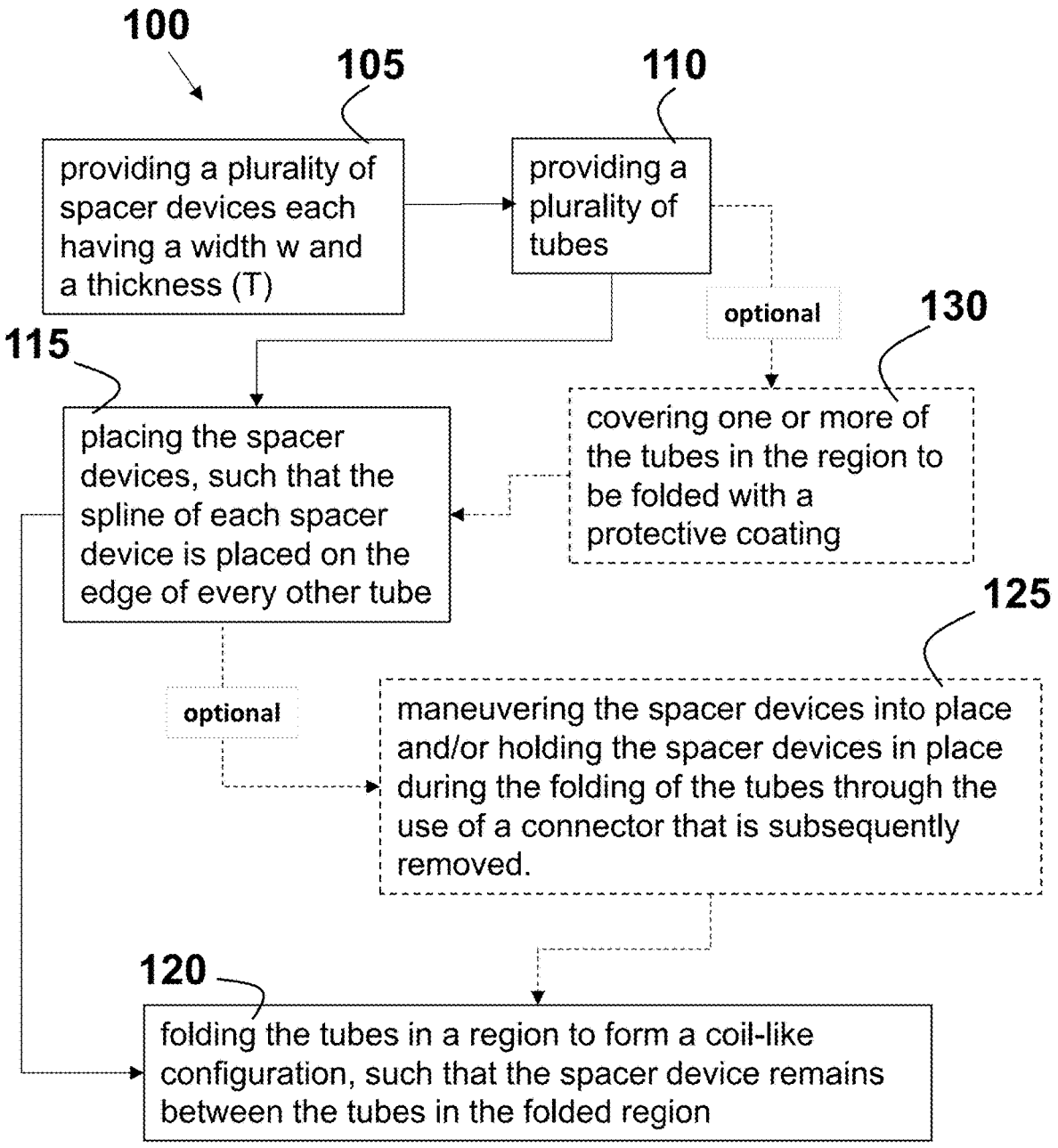
FIG. 5 is a flowchart illustrating a method for providing and maintaining separation between tubes during the formation of the bent-tube heat exchanger of FIG. 4.

According to yet another aspect of the present disclosure, a method for providing and maintaining separation between tubes during the formation of a bent-tube heat exchanger is provided. Referring now to FIG. 5, this method 100 comprises the steps of providing 105 a plurality of spacer devices having a thickness (T) and including a spine with a width (w) and one or more fingers protruding from each side of the spine as previously described above and further defined herein; providing 110 a plurality of tubes; placing 115 the spacer devices, such that the spine of each spacer device is placed on the edge of every other tube, such that each finger in the spacer device is located between two of the tubes in a region that is to be folded or bend; and folding 120 the tubes in the region to form a coil-like configuration, such that the spacer device remains between the tubes in the folded region.

The thickness (T) of the spacer device represents the separation that is provided and maintained by the fingers between the tubes in the folded region. The fingers in the spacer device may be curved into a predetermined shape that provides an angle (a) with respect to the center-line (c) of the spine, such that the fingers are compatible with and assist in the folding of the tubes. The fingers of the spacer device lay on the tubes, thereby, exerting a force onto the tubes and providing the separation between the tubes.

The placement 115 of the spacer devices onto the edge of every other tube may be done manually or robotically. In addition, the use of a removable connector between multiple spacer devices that aids in the placement of the spacer devices onto the edge of every other tube is contemplated to be within the scope of the present disclosure. Thus, the spacer devices may be maneuvered 125 and/or held in place through the use of a connector located between two or more of the spacer devices. This connector is subsequently removed after the placement of the devices. The means of reversible connection between the spacer devices may include, but not be limited to, the placement of the spacer devices at predetermined intervals along a cord or line, wherein the spacer devices are attached to said cord or line in an easily removable fashion.

When desirable, this method 100 may further comprise the step of covering 130 one or more of the tubes in the region to be folded with a protective coating that either provides a physical barrier between the tubes and the oxidizing elements in the environment or is a sacrificial material that preferentially corrodes before the tubes.

For the purpose of this disclosure the terms "about" and/or "substantial" are used herein with respect to measurable values and ranges due to expected variations known to those skilled in the art (e.g., limitations and variability in measurements).

For the purpose of this disclosure, the terms "at least one" and "one or more of' an element are used interchangeably and may have the same meaning. These terms, which refer to the inclusion of a single element or a plurality of the elements, may also be represented by the suffix "(s)" at the end of the element. For example, "at least one manifold", "one or more manifolds", and "manifold(s)" may be used interchangeably and are intended to have the same meaning.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A bent-tube heat exchanger; the heat exchanger comprising:

a plurality of tubes folded in a region to form a coil-like configuration having a flattened cross-section along with multiple parallel flow channels;

a plurality of fins that extend between the tubes;

one or more manifolds that form an inlet and outlet for fluid flow within the heat exchanger; each of the plurality of tubes being in fluid communication with the one or more manifolds; and a plurality of spacer devices, each spacer device comprising one or more fingers protruding from opposite sides of a spine, the fingers exerting a force against the tubes in the folded region;

wherein the bent-tube heat exchanger includes one spacer device for every two tubes;

wherein the plurality of spacer devices provides and maintains a separation between the tubes in the folded region;

wherein each of the plurality of spacer devices is not attached to a mounting fixture nor does each of the plurality of spacer devices span multiple tubes.

2. The heat exchanger according to claim 1, wherein one of the plurality of spacer devices is bent over the edge of every other tube in the folded region.

3. The heat exchanger according to claim 1, wherein the spacer device is made of one or more soft plastic or hard rubber materials having a hardness in the range of about 5 to about 85 Shore A durometer or less than 45 Shore D durometer.

4. The heat exchanger according to claim 1, wherein the spacer device has a thickness (T) that represents the separation provided and maintained by the fingers between the tubes in the folded region.

5. The heat exchanger according to claim 1, wherein at least one of the tubes in the folded region is covered with a protective coating that either provides a physical barrier between the tubes and the oxidizing elements in the environment or is a sacrificial material that preferentially corrodes before the tubes.

6. The heat exchanger according to claim 1, wherein the number of fingers located on opposite sides of the spine of the spacer device is equal to or greater than two.

7. The heat exchanger according to claim 1, wherein one or more of the fingers located on opposite sides of the spine of the spacer device are curved into a predetermined shape that provides an angle ($\alpha$) with respect to the center-line (c) of the spine.

8. The heat exchanger according to claim 1, wherein the spine has a width (w) that is equal to or greater than the width of the flow channel established by the tubes when bent in the folded region.

9. The heat exchanger according to claim 1, wherein the spacer device further comprises a slit located on opposite edges of the spine, the slit separating the fingers located on the opposite sides of the spine;

wherein the slit is configured to assist in the placement of and/or the folding of the tubes.

10. The heat exchanger according to claim 3, wherein the soft plastic or hard plastic material is polyurethanes, thermoplastic elastomers (TPEs), polyolefins, epoxies, fluoropolymers, silicones, polyamide, polycarbonate, polyesters, polyethylene, polyvinyl chloride, natural rubber (NR), styrene-butadiene rubber (SBR), ethylene propylene diene monomer rubber (EPDM), nitrile butadiene rubber (NBR) and/or mixtures and combinations thereof.

11. The heat exchanger according to claim 1, wherein the spacer device assists in the drainage of condensate from the folded region of the tubes that form the heat exchanger.

12. A method for providing and maintaining separation between tubes during the formation of a bent-tube heat exchanger according to claim 10, wherein the method comprises:

providing a plurality of spacer devices with each spacer device having a thickness (T) and comprising one or more fingers protruding from opposite sides of a spine;

providing a plurality of tubes;

placing one of the spacer devices on every other tube, such that each finger in the spacer device is located between two of the tubes; and folding the tubes in a region to form a coil-like configuration, such that the spacer device remains between the tubes in the folded region;

wherein the thickness (T) of the spacer device represents the separation that is provided and maintained by the fingers between the tubes in the folded region;

wherein each of the plurality of spacer devices is not attached to a mounting fixture nor does each of the plurality of spacer devices span multiple tubes.

13. The method according to claim 12, wherein the method further comprises the step of covering one or more of the tubes in the region to be folded with a protective coating that either provides a physical barrier between the tubes and the oxidizing elements in the environment or is a sacrificial material that preferentially corrodes before the tubes.

14. The method according to claim 12, wherein the spacer device includes fingers that are curved into a predetermined shape that provides an angle ($\alpha$) with respect to the center-line (c) of the spine, such that the fingers are compatible with and assist in the folding of the tubes.

15. The method according to claim 12, wherein the fingers of the spacer device lay on the tubes, thereby, exerting a force onto the tubes and providing the separation between the tubes.

16. The method according to claim 12, wherein the method further comprises the step of maneuvering the spacer devices into place through the use of a connector located between two or more spacer devices;

wherein the connector is removed after placement of the spacer devices.

* * * * *